US011002054B2

(12) United States Patent
Stoepker

(10) Patent No.: US 11,002,054 B2
(45) Date of Patent: May 11, 2021

(54) SLIDING DOOR MECHANISM

(71) Applicant: GM Global Technology Operations LLC, Detroit, MI (US)

(72) Inventor: Robert D. Stoepker, Sterling Heights, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 34 days.

(21) Appl. No.: 16/185,717

(22) Filed: Nov. 9, 2018

(65) Prior Publication Data

US 2020/0149333 A1 May 14, 2020

(51) Int. Cl.
*E05D 15/10* (2006.01)
*E05D 15/30* (2006.01)

(52) U.S. Cl.
CPC ..... *E05D 15/101* (2013.01); *E05D 15/1047* (2013.01); *E05D 15/30* (2013.01); *E05Y 2900/531* (2013.01)

(58) Field of Classification Search
CPC ... E05D 15/101; E05D 15/1047; E05D 15/30; E05D 15/1057; E05Y 2900/531; E05Y 2201/64; B60J 5/06; Y10T 16/379
USPC ..... 49/213, 214, 215
See application file for complete search history.

(56) References Cited

U.S. PATENT DOCUMENTS 4,464,863 A * 8/1984 Chikaraishi ..... B60J 5/062 49/213
4,862,640 A * 9/1989 Boyko ..... B60J 5/06 49/213
4,953,819 A * 9/1990 Davis ..... A61M 5/1415 211/107
5,979,971 A * 11/1999 Mizuki ..... E05B 65/0811 296/155
6,286,260 B1 * 9/2001 Grabowski ..... E05D 15/1047 49/216
7,641,261 B2 * 1/2010 Rusnak ..... E05D 15/101 296/155
7,654,608 B2 * 2/2010 Krajenke ..... E05D 15/101 296/155
7,669,367 B2 * 3/2010 Shimura ..... B60J 5/06 49/213
8,070,102 B2 * 12/2011 Kobayashi ..... B64C 1/1438 244/129.4
8,807,626 B2 * 8/2014 Kwon ..... E05D 15/101 296/155
(Continued)

FOREIGN PATENT DOCUMENTS

CN 108016260 A 5/2018

*Primary Examiner* — Victor D Batson
*Assistant Examiner* — Matthew J Sullivan

(57) ABSTRACT

A sliding door mechanism includes a track that is fixed in position relative to a door opening, a post fixed in position relative to the track, and a member that is moveable longitudinally with respect to the track, the member being configured to be guided by the track. The mechanism further includes an arm mounted to the member, the arm rotatable about a vertical axis and configured to be pivotably attached to the sliding door. The arm defines a slot that is configured to receive the post as the door is moved from an open position toward a closed position such that the post urges the arm to rotate relative to the carriage such that the arm transmits a force to the door to urge the door to move laterally into the door opening.

19 Claims, 4 Drawing Sheets

(56) References Cited

U.S. PATENT DOCUMENTS

| | | | | |
|---|---|---|---|---|
| 9,163,443 | B2 * | 10/2015 | Yun | E05D 15/10 |
| 9,297,192 | B2 * | 3/2016 | Choi | B60J 5/06 |
| 9,475,368 | B2 * | 10/2016 | Choi | E05C 3/124 |
| 9,493,056 | B2 * | 11/2016 | Choi | B60J 5/047 |
| 9,545,834 | B2 * | 1/2017 | Choi | B60J 5/06 |
| 9,637,968 | B2 * | 5/2017 | Guitar | E05F 15/646 |
| 9,670,708 | B2 * | 6/2017 | Tsubaki | E05F 15/646 |
| 9,688,124 | B1 * | 6/2017 | Okuma | B60J 5/0493 |
| 9,701,183 | B2 * | 7/2017 | Choi | B60J 5/06 |
| 9,718,331 | B2 * | 8/2017 | Maruyama | E05D 15/1047 |
| 9,896,871 | B2 * | 2/2018 | Ungetheim | E05D 15/1047 |
| 10,119,316 | B2 * | 11/2018 | Westgarth | E05D 15/1047 |
| 2010/0078961 | A1 * | 4/2010 | Takaya | E05D 15/1047 296/155 |
| 2014/0237901 | A1 * | 8/2014 | Kwon | E05D 15/1047 49/449 |
| 2018/0119465 | A1 * | 5/2018 | Wojdyla | E05D 15/30 |

* cited by examiner

SLIDING DOOR MECHANISM

INTRODUCTION

The present disclosure relates to a mechanism for moving a sliding door toward a door opening as the door closes and moving the sliding door away from the door opening as the door opens.

Sliding doors are used on some vehicles, for example on vans, to provide access to the interior of the vehicle through a door opening without requiring the clearance next to the vehicle that would be necessary if a hinged door was used in the door opening. Sliding doors generally are substantially planar and are moved along a plurality of tracks that are substantially parallel to the plane of the door. The tracks are commonly shaped so as to have a portion that is not parallel to the plane of the door to allow the door to fit substantially flush when closed and to have the necessary clearance between the door and adjacent body panels when opened.

While current sliding door mechanisms achieve their intended purpose, there is a need for a new and improved system and method for sliding door mechanisms.

SUMMARY

According to several aspects, a mechanism for guiding a sliding door configured to be received in a door opening, includes a track that is fixed in position relative to the door opening, the track extending substantially linearly in a longitudinal direction. The mechanism also includes a post fixed in position relative to the track, a member that is moveable longitudinally with respect to the track and configured to be guided by the track, and an arm mounted to the member, the arm rotatable about a vertical axis defined by the member and configured to be hingedly coupled to the sliding door. The arm defines a slot that is configured to receive the post as the door is moved from an open position toward a closed position such that the post urges the arm to rotate about the vertical axis defined by the member such that the arm transmits a force to the door to urge the door to move laterally into the door opening.

In an additional aspect of the present disclosure, the track defines a carriage groove extending substantially in the longitudinal direction. The member includes a carriage and a first guide roller and a second guide roller that are rotatably affixed to the carriage. The first guide roller and the second guide roller are disposed in the carriage groove such that longitudinal motion of the carriage is guided by cooperation between the carriage groove and the first and second guide rollers.

In a further aspect of the present disclosure, the first guide roller and the second guide roller are disposed in the carriage groove with a clearance fit between the carriage groove and the first and second guide rollers.

In another aspect of the present disclosure, the mechanism further includes a wheel rotatably affixed to the carriage, the wheel configured to roll on the track.

In an additional aspect of the present disclosure, the wheel is disposed in the carriage groove.

In another aspect of the present disclosure, the track defines a carriage groove extending substantially in the longitudinal direction, and the member includes an element having a slip fit in the carriage groove.

In an additional aspect of the present disclosure, the track defines a guide groove having a first straight portion and a second curved portion. The arm has a third guide roller rotatably affixed thereto. The third guide roller is disposed in the guide groove with a clearance fit between the guide groove and the third guide roller.

In a further aspect of the present disclosure, a cover is affixed to the track so as to limit vertical motion of the arm relative to the track.

In another aspect of the present disclosure, the track includes a stabilizing wall extending longitudinally along a portion of the track. The stabilizing wall is configured to cooperate with a side of the arm to limit rotation of the arm relative to the carriage when the carriage is longitudinally positioned such that the side of the arm is located adjacent to the stabilizing wall.

In another aspect of the disclosure, a door bracket is pivotably mounted to the arm by a pin installed through a first hole defined in the door bracket and through a second hole defined in a distal extension of the arm. The door bracket is configured to have a door mounted thereto.

According to several aspects, a mechanism for guiding a sliding door configured to be received in a door opening includes a track that is fixed in position relative to the door opening, the track extending substantially linearly in a longitudinal direction. The mechanism also includes a member that is moveable longitudinally with respect to the track, the member being configured to be guided by the track. The mechanism also includes an arm mounted to the member, the arm rotatable about a vertical axis defined by the member and configured to be hingedly coupled to the sliding door. The track defines a guide groove having a first straight portion and a second curved portion. The arm has a guide element affixed thereto, wherein the guide element is disposed in the guide groove with a clearance fit between the guide groove and the guide element. As the door is moved from an open position toward a closed position the guide element urges the arm to rotate about the vertical axis defined by the member such that the arm transmits a force to the door to urge the door to move laterally into the door opening.

In an additional aspect of the present disclosure, the track defines a carriage groove extending substantially in the longitudinal direction. The member includes a carriage that includes a first guide roller and a second guide roller rotatably affixed to the carriage, the first guide roller and the second guide roller being disposed in the carriage groove such that motion of the carriage is guided by cooperation between the carriage groove and the first and second guide rollers.

In an additional aspect of the present disclosure, the first guide roller and the second guide roller are disposed in the carriage groove with a clearance fit between the carriage groove and the first and second guide rollers.

In a further aspect of the present disclosure, the mechanism includes a wheel rotatably affixed to the carriage, the wheel configured to roll on the track.

In an additional aspect of the present disclosure, the wheel is disposed in the carriage groove.

In another aspect of the present disclosure, a post is fixed in position relative to the track. The arm defines a slot that is configured to receive the post as the door is moved from an open position toward a closed position such that the post urges the arm to rotate relative to the carriage.

In an additional aspect of the present disclosure, the mechanism further includes a cover affixed to the track so as to limit vertical motion of the arm relative to the track.

In a further aspect of the present disclosure, a plurality of balls is disposed between the cover and a top surface of the arm.

In an additional aspect of the present disclosure, the track includes a stabilizing wall extending longitudinally along a portion of the track. The stabilizing wall is configured to cooperate with a side of the arm to limit rotation of the arm relative to the carriage when the carriage is longitudinally positioned such that the side of the arm is located adjacent to the stabilizing wall.

In another aspect of the present disclosure, a door bracket is pivotably mounted to the arm by a pin installed through a first hole defined in the door bracket and through a second hole defined in a distal extension of the arm. The door bracket is configured to have the sliding door mounted thereto.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

Figure 1:
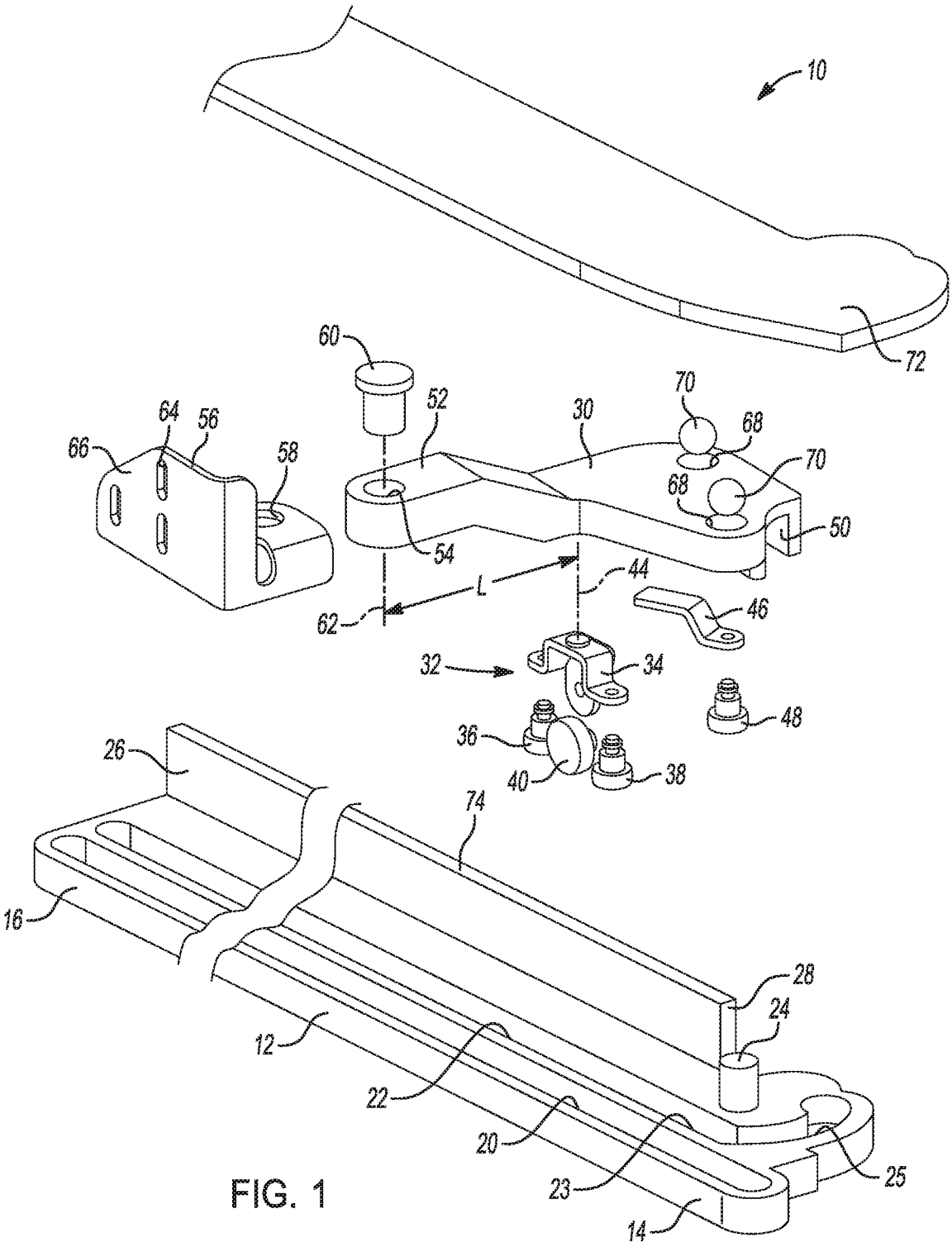
FIG. 1 is an exploded view of a sliding door mechanism according to an exemplary embodiment.

The following description is merely exemplary in nature and is not intended to limit the present disclosure, application, or uses.

A sliding door used on a vehicle commonly uses three tracks to support and guide the door as it opens and closes. A substantially horizontal top track is mounted to the vehicle body above the door opening. A top roller affixed to the door near the top of the door and near the front edge of the door (assuming a door that is opened by moving the door toward the rear of the vehicle) is guided and supported by the top track. A substantially horizontal center track is mounted to the vehicle body at an intermediate height between the top and the bottom of the door opening. A center roller affixed to the door at the height of the center track and near the rear edge of the door (assuming a door that is opened by moving the door toward the rear of the vehicle) is guided and supported by the center track. A substantially horizontal bottom track is mounted to the vehicle body below the door opening. A bottom roller affixed to the door near the bottom of the door and near the front edge of the door (assuming a door that is opened by moving the door toward the rear of the vehicle) is guided and supported by the bottom track.

It is desirable for the outside surface of the door to be substantially flush with adjacent body panels when the door is closed. It is also necessary for the door in its open position to be offset by a predetermined clearance distance from the body panel that is adjacent to the door opening. This requires that, as the door is moved from a closed positon to an open position, the door is moved outwardly away from the adjacent body panels so that there is clearance between the inner surface of the door and the adjacent body panels when the door is opened. This also requires that as the door is moved from an open position to a closed position it is moved inwardly into the opening.

To achieve the necessary clearance when opened while allowing the door to fit substantially flush with the adjacent body panels when closed, each of the tracks is commonly shaped so as to have a first portion extending in a fore-aft direction relative to the vehicle body, and a second portion that is angled inward relative to the fore-aft direction to guide the door inwardly in the cross-vehicle direction as the door is closed. It will be appreciated that the angled portion of each track intrudes into the vehicle in a cross-car direction, beyond the intrusion of the straight portion of each track, by a depth substantially equal to the distance the door is required to move outwardly from the closed position (where the outer surface of the door is flush with the adjacent body panel) to the open position (where clearance is provided between the inner surface of the door and the adjacent body panel). The distance the door is required to move outwardly is the sum of the door thickness and the clearance distance.

As used herein, the terms "longitudinal" and "longitudinally" refer to a lengthwise direction parallel to the predominant opening and closing direction of a sliding door. For a sliding door installed on a side (i.e. right side or left side) of a vehicle, the longitudinal direction is a direction substantially parallel to the direction of motion of the vehicle as it is driven in a straight line. As used herein, the terms "lateral" and "laterally" refer to a substantially horizontal direction that is substantially perpendicular to the longitudinal direction. The lateral direction is alternatively referred to herein as the "cross-car" direction. As used herein the terms "vertical" and "vertically" refer to a direction that is substantially perpendicular to both the longitudinal and lateral directions.

Referring to FIG. 1, an exploded view of a non-limiting embodiment of a mechanism 10 for guiding a sliding door is depicted. The mechanism 10 includes a track 12 extending longitudinally in a direction parallel to the opening and closing direction of the sliding door. The track 12 has a first end 14 in the direction of the closing direction of the sliding door, and a second end 16 in the direction of the opening direction of the sliding door. The track 12 defines a carriage groove 20 and a guide groove 22. The carriage groove 20 extends longitudinally. The guide groove 22 has a first portion 23 that extends parallel to the carriage groove 20 over a portion of the length of the track 12 and a second portion 25 that curves away from the carriage groove 20 in the vicinity of the first end 14 of the track 12. A post 24 is affixed to the track 12 and protrudes from the track 12. A stabilizing wall 26 having a top surface 74 is affixed to the track 12. The stabilizing wall 26 has an end 28 in the vicinity of the first end 14 of the track 12.

Figure 2:
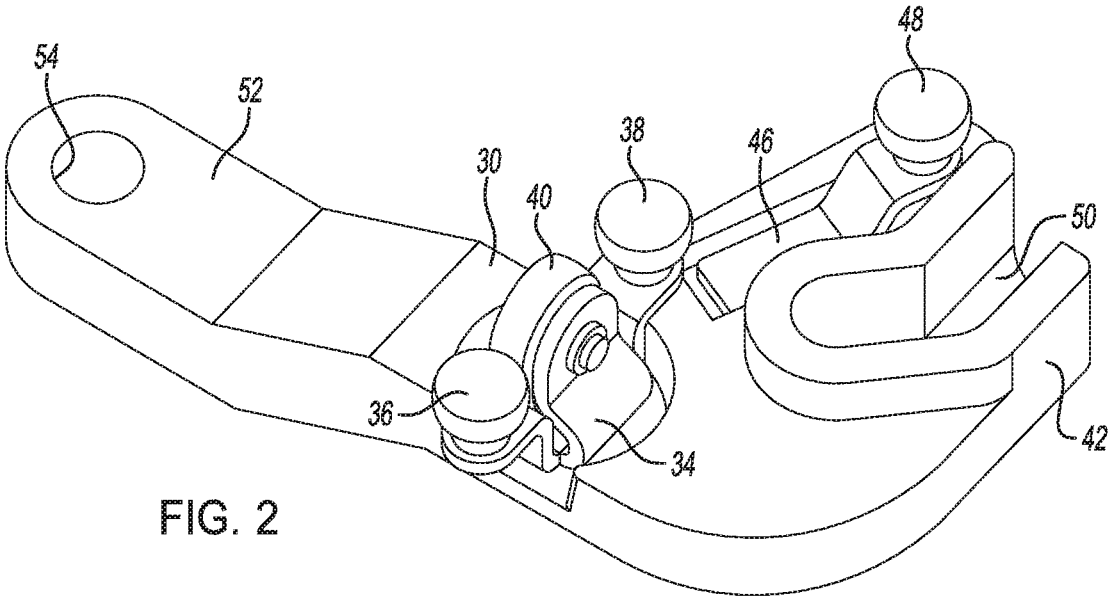
FIG. 2 is an alternative view of elements of the mechanism of FIG. 1 according to an exemplary embodiment.

With continued reference to FIG. 1, the mechanism 10 also includes an arm 30. FIG. 2 depicts the arm 30 and several other elements associated with the arm 30 from a vantage point looking from the underside of the arm relative to the orientation shown in FIG. 1. Referring to FIG. 2 and again to FIG. 1, the arm is configured to receive a member in the form of a carriage assembly 32. The carriage assembly 32 includes a carriage frame 34. A first guide roller 36, a second guide roller 38, and a wheel 40 are rotatably affixed to the carriage frame 34. The first guide roller 36 and the second guide roller 38 are sized to provide a clearance fit in the carriage groove 20. The wheel 40 is configured to provide support for the weight of the arm 30 as well as the weight of the door and/or other elements coupled to the arm 30. The carriage frame 34 is pivotably affixed to the arm 30 such that the arm 30 can rotate about an axis 44 with respect to the carriage frame 34. In an alternative embodiment (not shown), the carriage assembly 32 may be replaced with an alternative member configured to travel longitudinally in the carriage groove 20 and having a feature configured to allow rotation of the arm 30 about the axis 44. A simple embodiment of the alternative member may comprise a cylindrical projection from the arm 30 along the axis 44, the cylindrical projection sized so as to interface with the carriage groove 20 with a slip fit. It will be appreciated that other alternative members, including but not limited to a block configured as a rectangular prism configured to slide in the carriage groove 20 and including a feature configured to cooperate with a complementary feature on the arm 30 to enable the arm 30 to rotate about the axis 44 with respect to the block, may be used without departing from the scope of the present disclosure.

With continued reference to the embodiment depicted in the Figures, the arm 30 is also configured to receive a roller bracket 46 to which a third guide roller 48 is rotatably affixed. The third guide roller 48 is sized to provide a clearance fit in the guide groove 22. The arm 30 also defines a slot 50 that is sized to allow a clearance fit between the slot 50 and the post 24. In the exemplary embodiment shown, the arm has a side surface 42, the function of which will be described below. The arm 30 has a distal extension 52 in which is defined a hole 54 having a central axis 62.

In the non-limiting exemplary embodiment shown, the distal extension 52 is configured to interface with a door bracket 56. As depicted in FIG. 1, the door bracket 56 defines a hole 58. A hinge pin 60 may be inserted through the holes 54 and 58 to allow a range of rotation of the bracket 56 about the central axis 62 with respect to the distal extension 52. The door bracket 56 has a substantially planar surface 66 configured to adjoin a corresponding surface on the sliding door. The door bracket 56 defines openings 64 configured to receive fasteners to affix the door bracket 56 to the sliding door. In an alternative embodiment, the function of the bracket 56 may be integrated into the sliding door. For example, the distal extension 52 of the arm 30 may be hingedly coupled to a coupling feature provided in the door without requiring the separate bracket 56.

Referring again to FIG. 1, the depicted embodiment of the mechanism 10 further includes a cover 72 configured to be affixed to the top surface 74 of the stabilizing wall 26. The arm 30 defines depressions 68 configured to accept balls 70. The balls 70 are configured to contact the underside of the cover 72 to limit vertical movement of the arm 30 while still enabling movement of the arm 30 along the track 12.

Figure 3A:
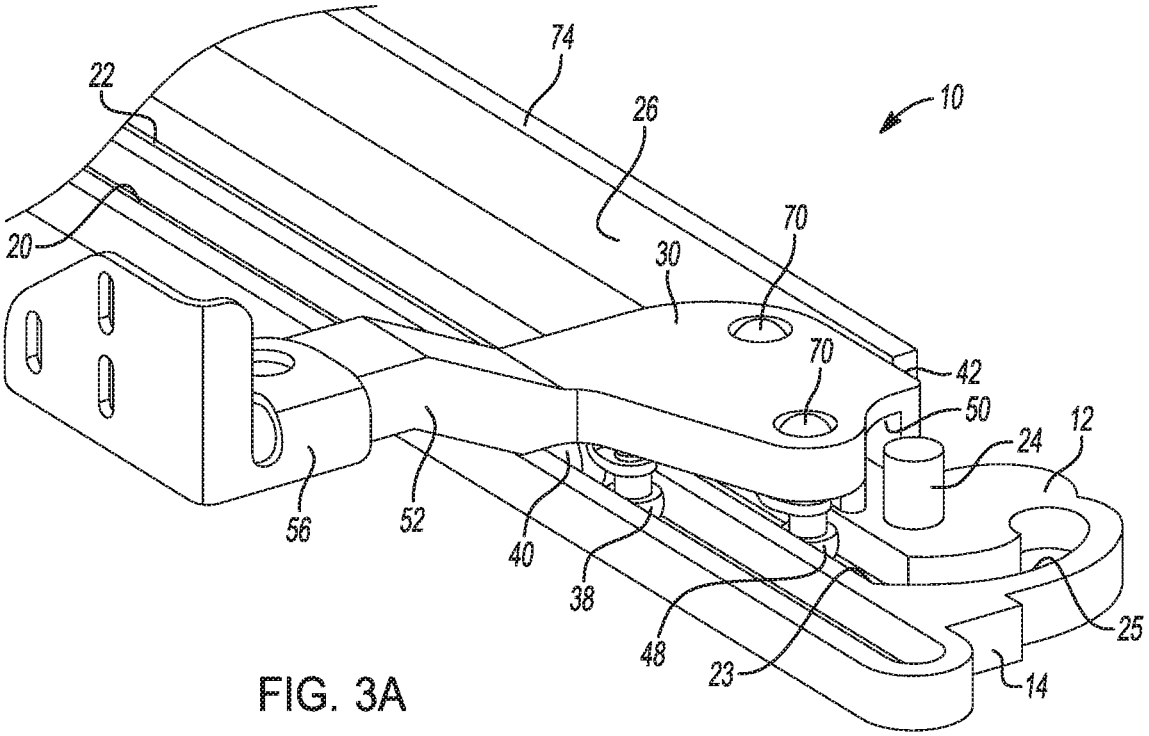
FIG. 3A is an assembly view of a portion of the mechanism of FIG. 1 when the sliding door is in a partially closed position according to an exemplary embodiment.
Figure 3B:
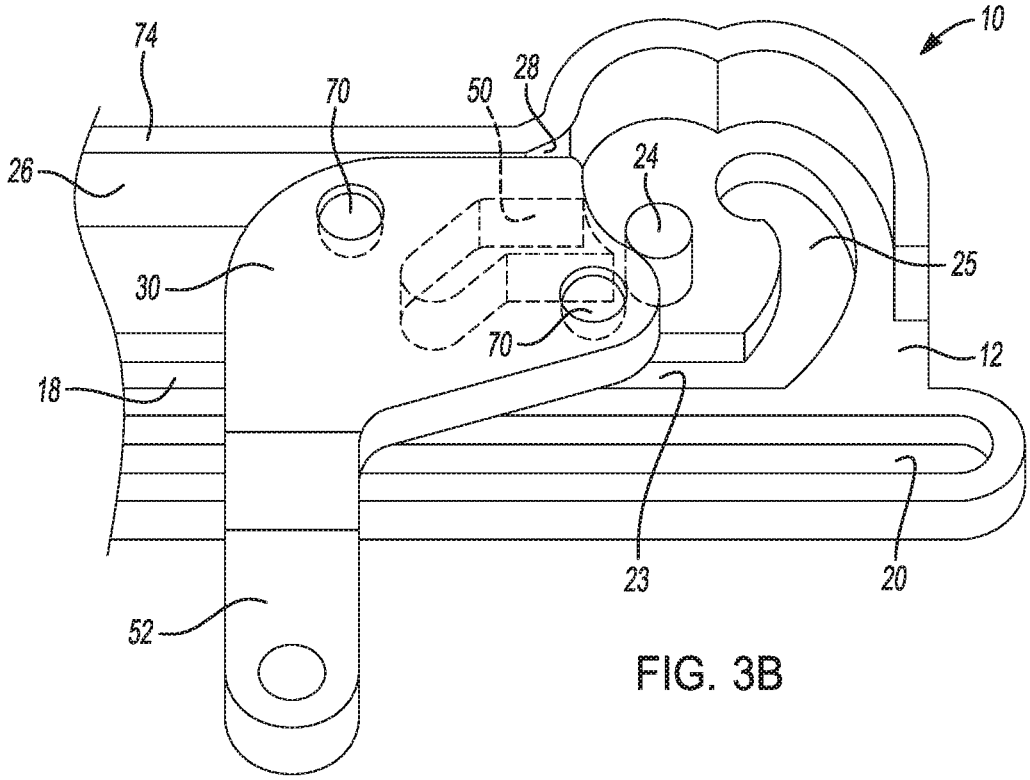
FIG. 3B is an assembly view of a portion of the mechanism of FIG. 1 when the sliding door is in the partially closed position shown in FIG. 3A, with internal features of the rotating arm indicated, according to an exemplary embodiment.

Referring to FIGS. 3A and 3B, an assembly view of a portion of the mechanism of FIG. 1 is presented. For clarity, the cover 72 is not shown in FIG. 3A and subsequent figures. In FIGS. 3A and 3B the arm is shown in a position when the sliding door is not fully closed. In operation, an external force, such as manual actuation or an electric motor drive mechanism, urges the door to move between an open position and a closed position. As the door moves, the door imparts a force on the door bracket 56 which, by way of the hinge pin 60, urges the arm 30 to move along the track 12. In the position shown in FIGS. 3A and 3B, the carriage assembly 32 is positioned such that the first guide roller 36, the second guide roller 38, and the wheel 40 are guided by the carriage groove 20. The third guide roller 48 is guided by the first portion 23 of the guide groove 22 that extends parallel to the carriage groove 20. The side surface 42 on the arm 30 is positioned adjacent to the stabilizing wall 26 to limit rotation of the arm 30 about the axis 44. The post 24 is aligned with the opening of the slot 50 in the arm 30, but the post 24 is not located in the slot 50. The relationship between the slot 50 and the post 24 is more clearly shown in FIG. 3B, which is an alternative view of the mechanism 10 in the position depicted in FIG. 3A with the shape and location of the slot 50 in the arm 30 indicated with dashed lines. The door bracket 56 is not shown in FIG. 3B.

Figure 4:
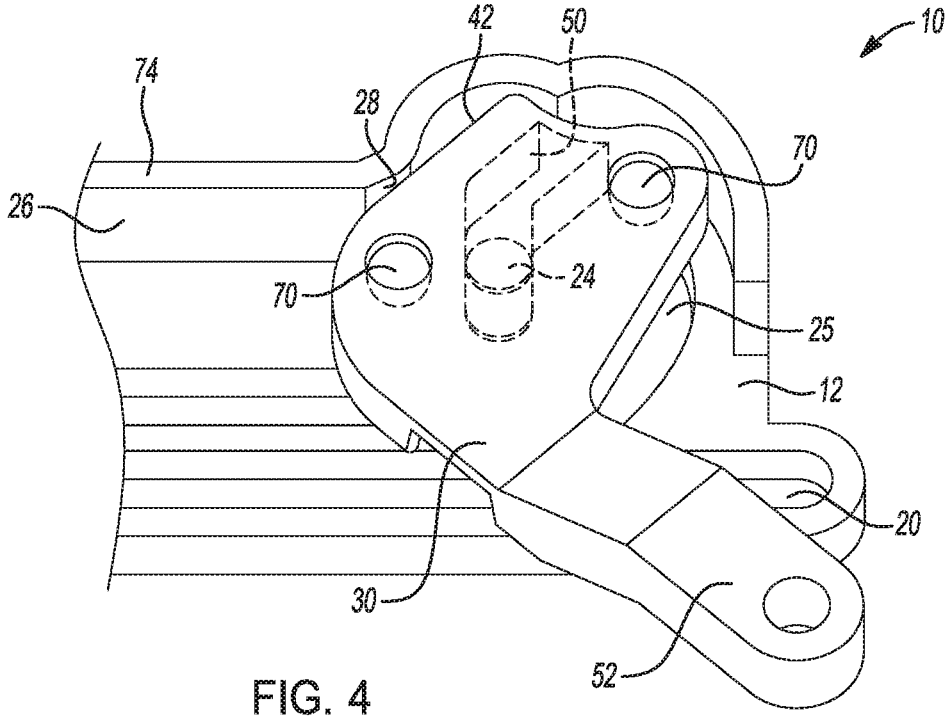
FIG. 4 is an assembly view of a portion of the mechanism of FIG. 1 when the sliding door is further toward its closed position than in the views of FIGS. 3A and 3B, according to an exemplary embodiment.

Referring to FIG. 4, an assembly view is presented of the mechanism 10 when the sliding door is not fully closed but is further toward its closed position than in the views of FIGS. 3A and 3B. In the position shown in FIG. 4, the carriage assembly 32 is positioned such that the first guide roller 36, the second guide roller 38, and the wheel 40 are guided by the carriage groove 20. The third guide roller 48 is guided by the second portion 25 of the guide groove 22 that curves away from the carriage groove 20. The post 24 is located in the slot 50. The side surface 42 on the arm 30 is positioned past the end 28 of the stabilizing wall 26, allowing rotation of the arm 30 about the axis 44, with the extent of rotation of the arm 30 being defined by cooperation between the post 24 and the slot 50 and by cooperation between the second guide roller 38 and the end of the carriage groove 20. As the arm 30 rotates in a counterclockwise direction in the view of FIG. 4, the motion of the distal extension 52 of the arm 30 has a component that pulls the door bracket 56 (not shown in FIG. 4) that is attached to the distal extension 52 at the hole 54 inwardly, i.e. in a direction perpendicular to the longitudinal opening-closing direction defined by the carriage groove 20.

Figure 5A:
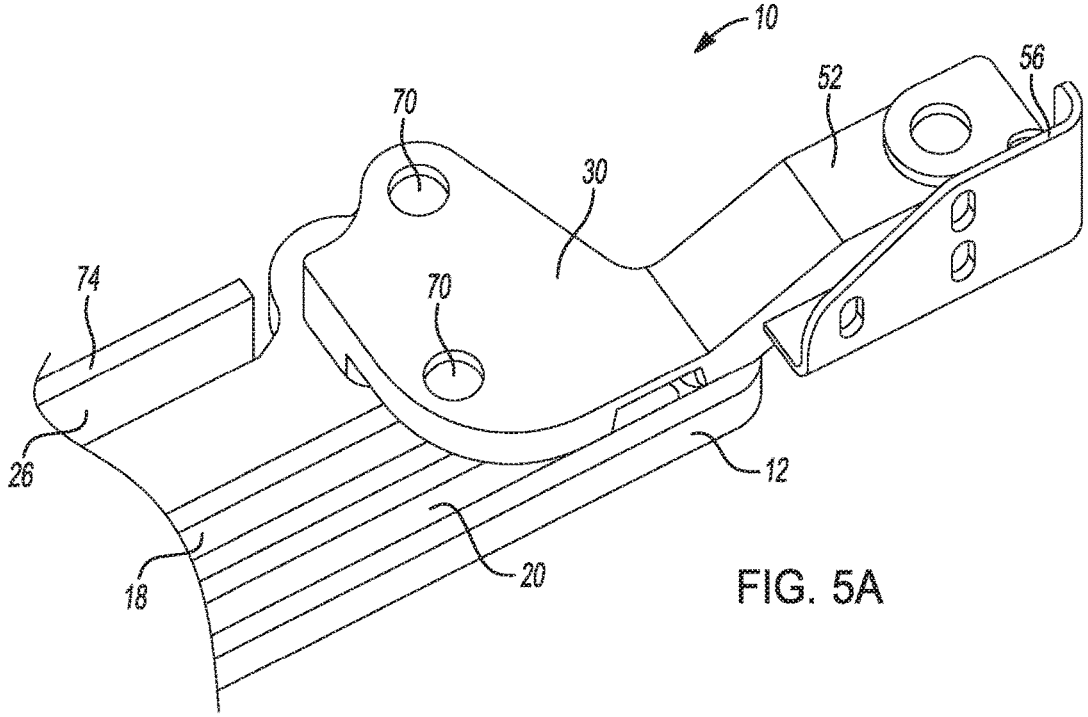
FIG. 5A is an assembly view of a portion of the mechanism of FIG. 1 when the sliding door is in a completely closed position according to an exemplary embodiment.
Figure 5B:
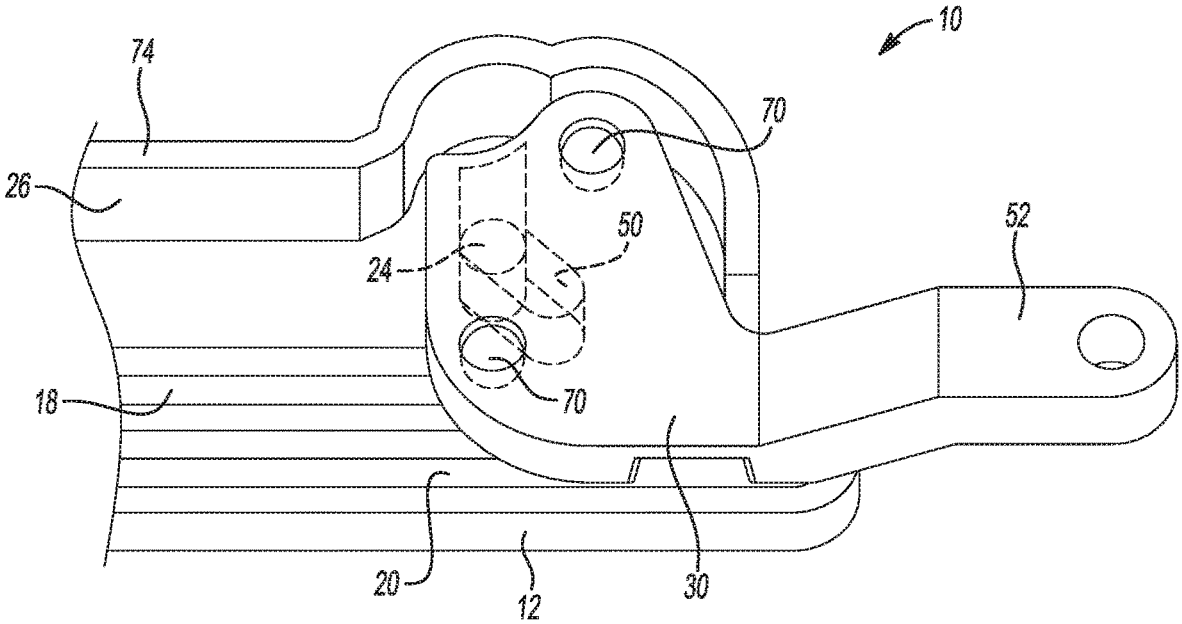
FIG. 5B is an assembly view of a portion of the mechanism of FIG. 1 when the sliding door is in the completely closed position shown in FIG. 5A, with internal features of the rotating arm indicated, according to an exemplary embodiment.

Referring to FIGS. 5A and 5B, an assembly view is presented of the mechanism 10 when the sliding door is in its closed position. In the position shown in FIGS. 5A and 5B, the carriage assembly 32 is positioned such that the first guide roller 36, the second guide roller 38, and the wheel 40 are guided by the carriage groove 20. The third guide roller 48 is located at the farthest extent of the second portion 25 of the guide groove 22 that curves away from the carriage groove 20. The post 24 is located in the slot 50. The side surface 42 on the arm 30 is positioned past the end 28 of the stabilizing wall 26, allowing rotation of the arm 30 about the axis 44, with the extent of rotation of the arm 30 being defined by cooperation between the post 24 and the slot 50 and by cooperation between the second guide roller 38 and the end of the guide groove 20. In the view of FIGS. 5A and 5B, the arm is rotated approximately 90 degrees from the position illustrated in FIGS. 3A and 3B, such that the door bracket 56 is positioned maximally inwardly, i.e. in a direction perpendicular to the longitudinal opening-closing direction defined by the carriage groove 20. The door bracket 56 is not shown in FIG. 5B.

It will be appreciated that the distance that the door can move inwardly and outwardly, i.e. in the direction perpendicular to the opening-closing direction, is established by "L" shown in FIG. 1, which is the distance between the axis 44 about which the arm 30 rotates about the carriage assembly 32 and the axis 62 about which the door bracket 56 rotates about the distal extension 52 of the arm 30.

A sliding door mechanism of the present disclosure offers several advantages. These include reducing the intrusion of a sliding door track into the vehicle in a cross-car direction. As discussed above, a conventional sliding door mechanism requires that the track have an angled portion that intrudes into the vehicle in a cross-car direction, beyond the intrusion of the straight portion of each track, by a depth substantially equal to the distance the door is required to move outwardly from the door closed position to the door open position. In contrast, the mechanism of the present disclosure achieves movement of the door in the cross-car direction by the distance indicated as "L" in FIG. 1, without requiring that the track intrude into the vehicle by the distance "L". Instead, in the present disclosure, the cross-car travel of the door as it opens and closes is determined by the length of the distal extension 52 of the arm 30. Thus, the mechanism of the present disclosure allows space in the interior of the vehicle that would otherwise be required to accommodate the curved track of a conventional sliding door mechanism to be available for other purposes.

Additionally, since the cross-car movement distance "L" is determined by the length of the distal extension 52 of the arm 30 rather than by the shape of a curved track, it is possible to accommodate vehicles requiring different cross-car movement distances by substituting an arm 30 with a different length "L". This may allow improvements in costs associated with providing tooling for and maintaining inventories of various curved tracks to meet the needs of various vehicles.

While the description above is directed to a vehicle application of a sliding door, it will be appreciated that the mechanism described herein may find application in other sliding door applications. For example, in an architectural application, a sliding door in a building may benefit from the mechanism of the present disclosure. Similarly, the disclosed mechanism may be advantageously applied to the door of an enclosure such as a cabinet.

The description of the present disclosure is merely exemplary in nature and variations that do not depart from the gist of the present disclosure are intended to be within the scope of the present disclosure. Such variations are not to be regarded as a departure from the spirit and scope of the present disclosure.

What is claimed is:

1. A mechanism for guiding a sliding door configured to be received in a door opening, the mechanism comprising:

a track that is fixed in position relative to the door opening, the track extending substantially linearly in a longitudinal direction;

a post fixed in position relative to the track;

a member that is moveable longitudinally with respect to the track, the member being configured to be guided by the track;

an arm mounted to the member, the arm rotatable about a vertical axis defined by the member, the arm configured to be hingedly coupled to the door; and a cover affixed to the track so as to limit vertical motion of the arm relative to the track, wherein the arm defines a slot that is configured to receive the post as the door is moved from an open position toward a closed position such that the post urges the arm to rotate about the vertical axis defined by the member such that the arm transmits a force to the door to urge the door to move laterally into the door opening.

2. The mechanism of claim 1, wherein the track defines a carriage groove extending substantially in the longitudinal direction, and wherein the member comprises a carriage and a first guide roller and a second guide roller rotatably affixed to the carriage, the first guide roller and the second guide roller being disposed in the carriage groove such that longitudinal motion of the carriage is guided by cooperation between the carriage groove and the first and second guide rollers.

3. The mechanism of claim 2, wherein the first guide roller and the second guide roller are disposed in the carriage groove with a clearance fit between the carriage groove and the first and second guide rollers.

4. The mechanism of claim 2, further including a wheel rotatably affixed to the carriage, the wheel configured to roll on the track.

5. The mechanism of claim 4, wherein the wheel is disposed in the carriage groove.

6. The mechanism of claim 1, wherein the track defines a carriage groove extending substantially in the longitudinal direction, and wherein the member comprises an element having a slip fit in the carriage groove.

7. The mechanism of claim 1, wherein the track defines a guide groove having a first straight portion and a second curved portion, wherein the arm has a third guide roller rotatably affixed thereto, wherein the third guide roller is disposed in the guide groove with a clearance fit between the guide groove and the third guide roller.

8. The mechanism of claim 1, wherein the track includes a stabilizing wall extending longitudinally along a portion of the track, the stabilizing wall configured to cooperate with a side of the arm to limit rotation of the arm relative to the carriage when the carriage is longitudinally positioned such that the side of the arm is located adjacent to the stabilizing wall.

9. The mechanism of claim 1, wherein a door bracket is pivotably mounted to the arm by a pin installed through a first hole defined in the door bracket and through a second hole defined in a distal extension of the arm a door bracket pivotably mounted to the arm, the door bracket configured to have the door mounted thereto.

10. A mechanism for guiding a sliding door configured to be received in a door opening, the mechanism comprising:

a track that is fixed in position relative to the door opening, the track extending substantially linearly in a longitudinal direction;

a member that is moveable longitudinally with respect to the track, the member being configured to be guided by the track; and an arm mounted to the member, the arm rotatable about a vertical axis defined by the member, the arm configured to be hingedly coupled to the door, wherein the track defines a guide groove having a first straight portion and a second curved portion, wherein the arm has a guide element affixed thereto, wherein the guide element is disposed in the guide groove with a clearance fit between the guide groove and the guide element such that as the door is moved from an open position toward a closed position the guide element urges the arm to rotate about the vertical axis defined by the member such that the arm transmits a force to the door to urge the door to move laterally into the door opening, and wherein the track defines a carriage groove extending substantially in the longitudinal direction, and wherein the member comprises a carriage and a first guide roller and a second guide roller rotatably affixed to the carriage, the first guide roller and the second guide roller being disposed in the carriage groove such that longitudinal motion of the carriage is guided by cooperation between the carriage groove and the first and second guide rollers.

11. The mechanism of claim 10, wherein the first guide roller and the second guide roller are disposed in the carriage groove with a clearance fit between the carriage groove and the first and second guide rollers.

12. The mechanism of claim 10, further including a wheel rotatably affixed to the carriage, the wheel configured to roll on the track.

13. The mechanism of claim 12, wherein the wheel is disposed in the carriage groove.

14. The mechanism of claim 10, wherein a post is fixed in position relative to the track, wherein the arm defines a slot that is configured to receive the post as the door is moved from an open position toward a closed position such that the post urges the arm to rotate relative to the member.

15. The mechanism of claim 10, further including a cover affixed to the track so as to limit vertical motion of the arm relative to the track.

16. The mechanism of claim 15, further including a plurality of balls disposed between the cover and a top surface of the arm.

17. The mechanism of claim 10, wherein the track includes a stabilizing wall extending longitudinally along a portion of the track, the stabilizing wall configured to cooperate with a side of the arm to limit rotation of the arm relative to the carriage when the carriage is longitudinally positioned such that the side of the arm is located adjacent to the stabilizing wall.

18. The mechanism of claim 10, wherein a door bracket is pivotably mounted to the arm by a pin installed through a first hole defined in the door bracket and through a second hole defined in a distal extension of the arm a door bracket pivotably mounted to the arm, the door bracket configured to have the door mounted thereto.

19. A mechanism for guiding a sliding door configured to be received in a door opening, the mechanism comprising:

a track that is fixed in position relative to the door opening, the track extending substantially linearly in a longitudinal direction;

a member that is moveable longitudinally with respect to the track, the member being configured to be guided by the track; and an arm mounted to the member, the arm rotatable about a vertical axis defined by the member, the arm configured to be hingedly coupled to the door, wherein the track defines a guide groove having a first straight portion and a second curved portion, wherein the arm has a guide element affixed thereto, wherein the guide element is disposed in the guide groove with a clearance fit between the guide groove and the guide element such that as the door is moved from an open position toward a closed position the guide element urges the arm to rotate about the vertical axis defined by the member such that the arm transmits a force to the door to urge the door to move laterally into the door opening, and wherein a post is fixed in position relative to the track, wherein the arm defines a slot that is configured to receive the post as the door is moved from an open position toward a closed position such that the post urges the arm to rotate relative to the member.

* * * * *